United States Patent [19]

Roberts

[11] Patent Number: 4,516,940

[45] Date of Patent: May 14, 1985

[54] PROPULSION UNIT FOR A WATER-BORNE VESSEL

[76] Inventor: Ernest F. Roberts, 164, Marine Parade, Leigh-on-Sea, Southend, Essex, England

[21] Appl. No.: 379,450

[22] Filed: May 18, 1982

[30] Foreign Application Priority Data

May 19, 1981 [GB] United Kingdom ..... 8115382

[51] Int. Cl.[3] ..... B63H 1/14; B63H 23/06

[52] U.S. Cl. ..... 440/53; 440/49; 440/56; 440/58; 440/65; 114/155

[58] Field of Search ..... 440/53, 51, 56, 55, 440/71, 58, 59, 112, 83; 114/154, 155; 244/51; 180/240, 24, 21, 23, 22, 261, 262, 260, 140; 74/417, 416, 330; 416/169 R

[56] References Cited

U.S. PATENT DOCUMENTS

| | | | |
|---|---|---|---|
| 1,276,741 | 8/1918 | Fazekas | 114/154 |
| 1,472,077 | 10/1923 | Lockwood | 416/169 |
| 1,745,235 | 9/1932 | Svendsen | 440/56 |
| 1,866,482 | 7/1932 | Olsen | 440/83 |
| 2,146,623 | 2/1939 | Caroland | 440/56 |
| 2,156,047 | 4/1939 | Arnold | 416/169 R |
| 2,564,605 | 8/1951 | Martin | 416/169 |
| 2,751,987 | 6/1956 | Kiekhaefer | 416/169 |
| 3,088,430 | 5/1963 | Champney | 440/56 |
| 3,150,631 | 9/1964 | Tillman | 440/56 |
| 3,230,739 | 1/1966 | Stewart | 416/169 |
| 3,321,024 | 5/1967 | Marconi | 416/169 |
| 3,335,803 | 8/1967 | Ranst | 416/169 |
| 3,478,620 | 11/1969 | Shimanckas | 74/417 |
| 3,521,589 | 7/1970 | Kemp | 440/58 |
| 3,683,841 | 8/1972 | Krautkremer | 440/56 |

FOREIGN PATENT DOCUMENTS

| | | | |
|---|---|---|---|
| 970227 | 7/1975 | Canada | 440/53 |
| 469329 | 7/1937 | United Kingdom . | |
| 883343 | 4/1960 | United Kingdom . | |
| 886169 | 1/1962 | United Kingdom . | |
| 993905 | 6/1965 | United Kingdom . | |
| 1203560 | 8/1970 | United Kingdom . | |
| 1208518 | 10/1970 | United Kingdom . | |
| 1226398 | 3/1971 | United Kingdom . | |
| 1294190 | 10/1972 | United Kingdom . | |
| 1474045 | 5/1977 | United Kingdom . | |

*Primary Examiner*—Trygve M. Blix
*Assistant Examiner*—Patrick Young
*Attorney, Agent, or Firm*—Toren, McGeady and Stanger

[57] ABSTRACT

A propulsion unit for a water-borne vessel has a drive transmission assembly comprising a drive shaft and a steering shaft which can be concentric with the drive shaft, a leg depending from the drive transmission assembly, for instance by way of a horizontal axis pivot connection so that the leg can be swung up, and a propeller housing supported on the lower end of the leg for rotary movement about the axis of the leg, for steering the vessel.

8 Claims, 5 Drawing Figures

PROPULSION UNIT FOR A WATER-BORNE VESSEL

THE INVENTION

According to the present invention, there is provided a propulsion unit for a water-borne vessel, the unit comprising:

a depending leg;

a propeller housing supported on the lower end portion of the leg, the propeller housing being rotatable generally about the axis of the leg for steering the vessel; and a drive transmission assembly having two concentric input shafts, a first, drive shaft for driving the propeller and a second, steering shaft for rotating the propeller housing generally about the axis of the leg.

The invention also provides such a propulsion unit in which the leg is mounted on the drive transmission assembly for pivoting about a substantially horizontal axis, so that the leg can be swung up about the pivot on striking an obstruction, there being disengagable clutch means between the drive transmission assembly and the leg, below the level of the pivot, so that the drive is disengaged when the leg is swung up. In this unit, it is not essential that the input shafts should be concentric, though it is desirable as it avoids external steering controls on the leg and also permits the unit to be swung without difficulty about the axis of the input shafts.

The propulsion unit can be used for any suitable water-borne vessel, such as boats in general, barges, scows, yachts or dinghies. The propulsion unit can be mounted on the transom of the vessel. Alternatively, particularly in the case of a yacht, the propulsion unit can be mounted towards the aft end, the leg passing through the bottom of the hull with a suitable waterproof seal. It is known to position drives in this manner in yachts, but in such arrangements, steering was achieved by means of a rudder.

Using the propulsion unit of the invention, the vessel can be steered even when it is stationary. In addition, a compact unit can be provided, and various safety features can be incorporated.

DESCRIPTION OF PREFERRED EMBODIMENTS

The invention will be further described, by way of example, with reference to the accompanying drawings, in which.

FIRST EMBODIMENT OF THE INVENTION

Figure 1:
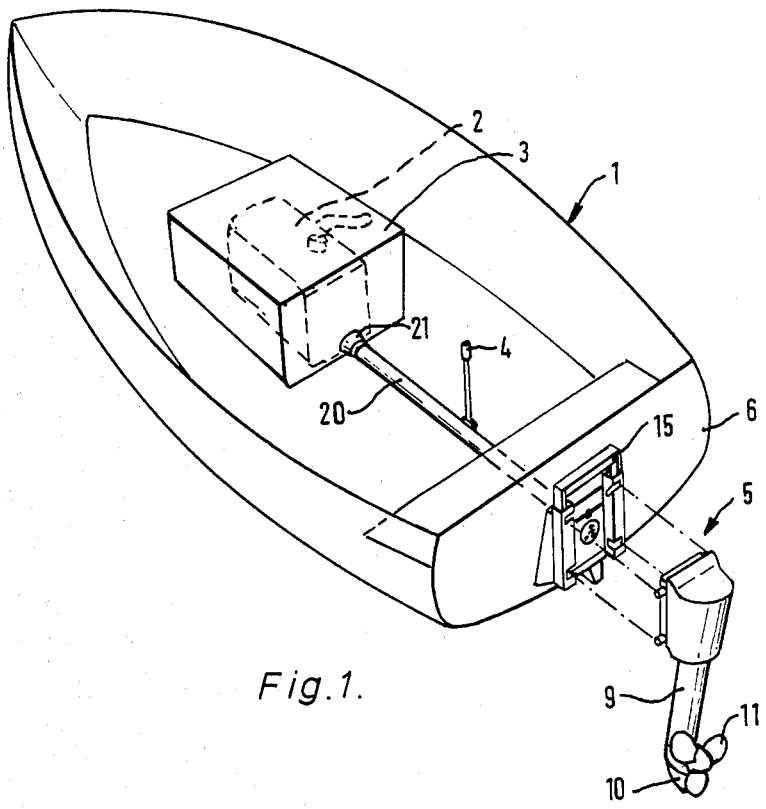
FIG. 1 is an isometric view of a water-borne vessel fitted with an inboard motor and a propulsion unit in accordance with the invention.

FIG. 1 illustrates a dinghy 1, but it will be appreciated that the propulsion unit of the invention can be applied to any suitable water-borne vessel. The dinghy 1 has a suitable inboard engine 2 in a housing 3, a tiller 4, and a propulsion unit 5 mounted on the transom 6.

Figure 2:
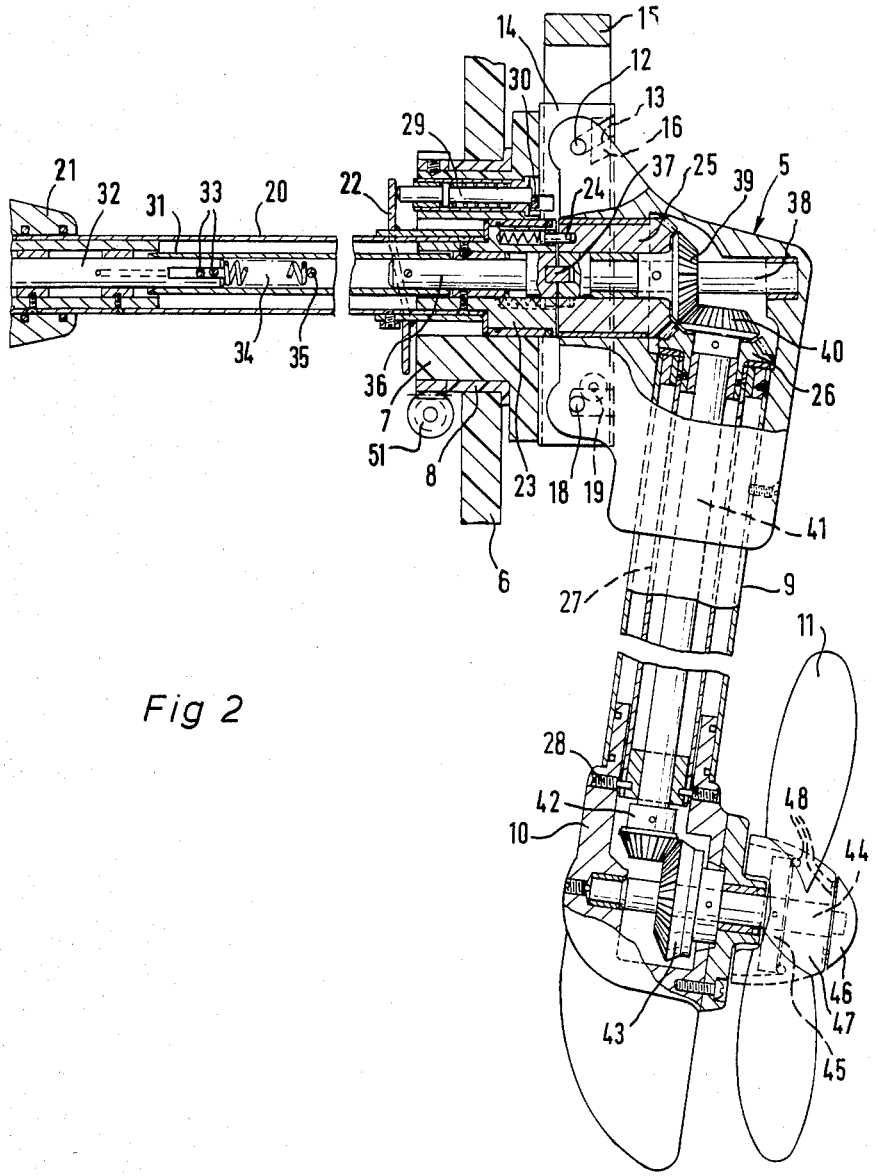
FIG. 2 is a vertical section, on a larger scale, through a similar propulsion unit.
Figure 3:
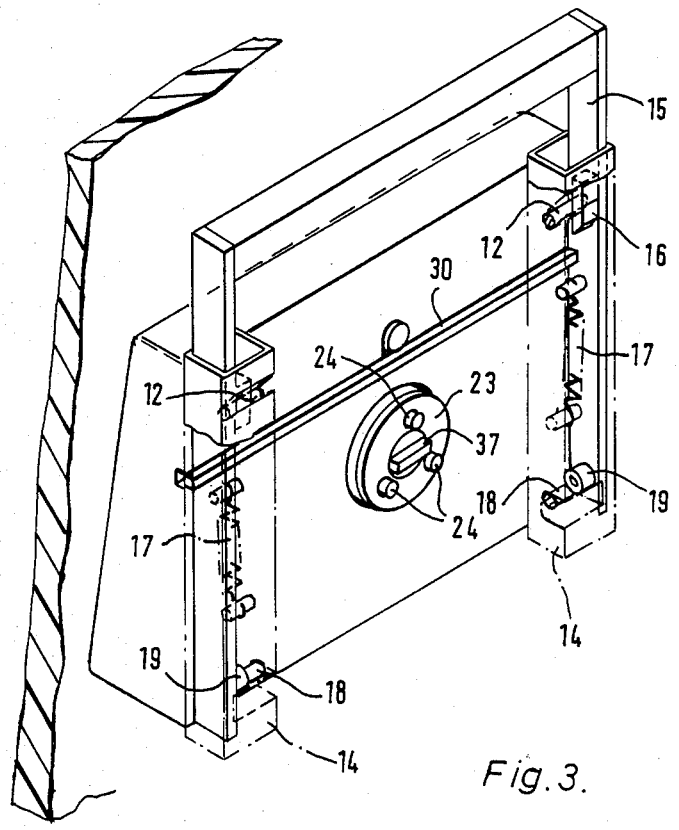
FIG. 3 is an isometric projection of part of FIG. 1, on a yet larger scale.
Figure 4:
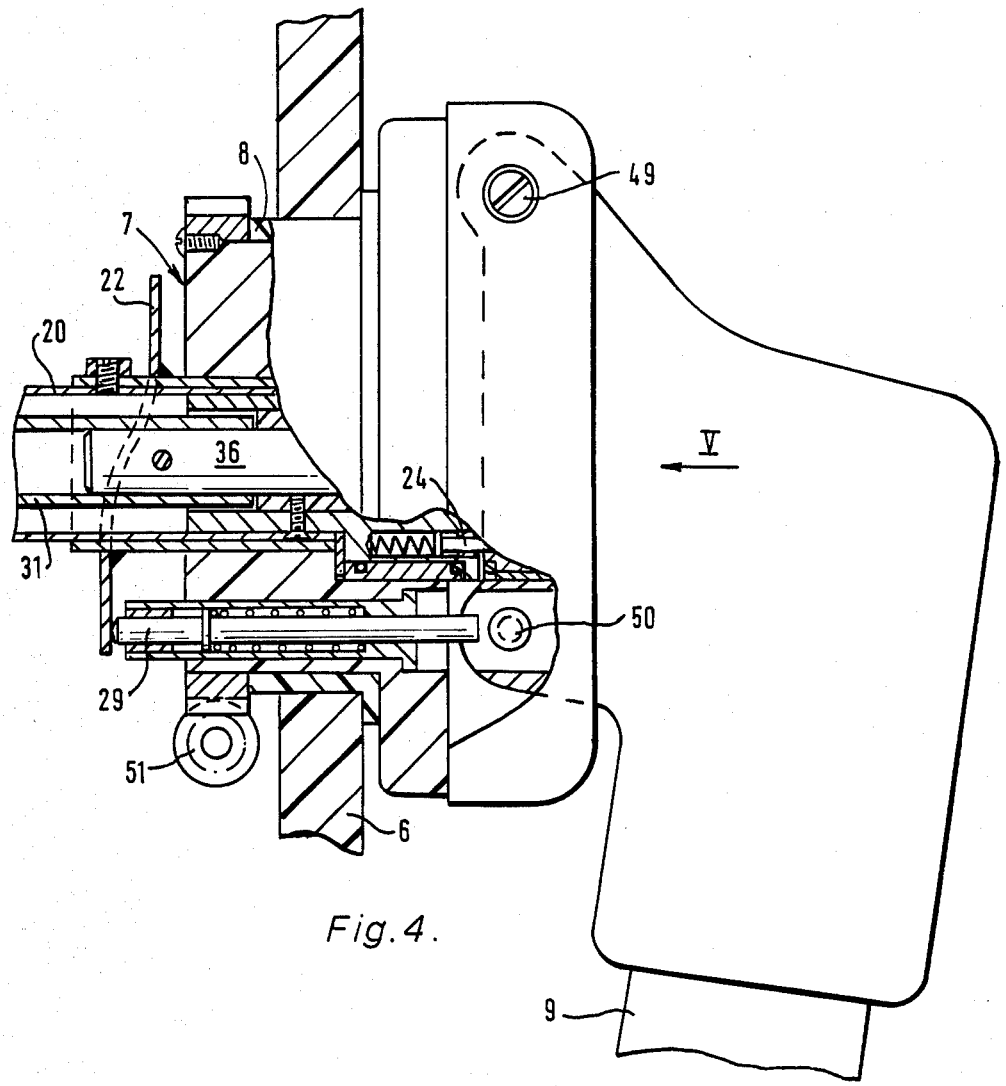
FIG. 4 is a part vertical section through part of a different propulsion unit.
Figure 5:
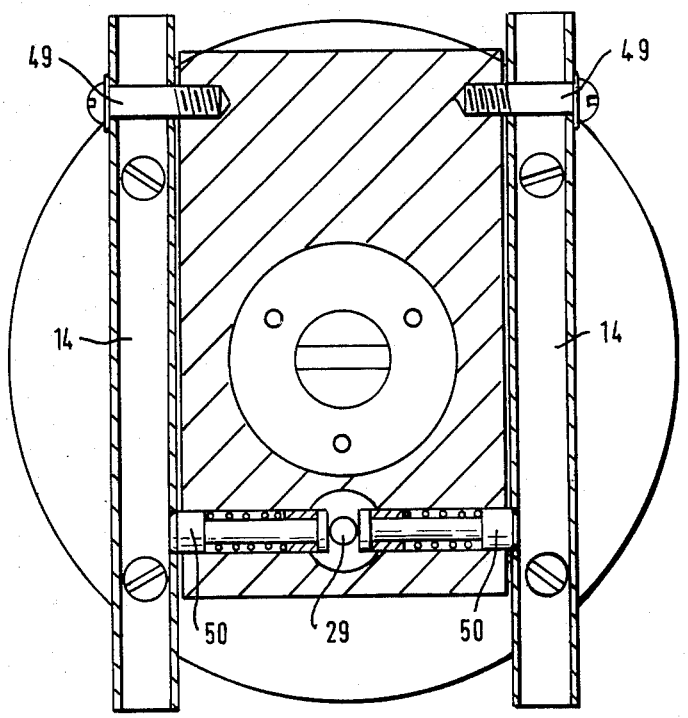
FIG. 5 is a view looking in the direction of the arrow V in FIG. 4, with the leg removed.

The propulsion unit 5 is shown in more detail in FIGS. 2 and 3. In general terms, the propulsion unit 5 has a drive transmission assembly 7 mounted by suitable mounting means on the transom 6. In this case, the assembly 7 is inserted through an aperture in the transom 6, with an interposed collar seal 8; the seal 8 is held in position by any suitable fixing means (not shown), e.g. by bolting the lip of the seal 8 to the transom 6. There is a depending leg 9 whose lower end supports a propeller housing 10 on which is rotatably mounted a propeller 11.

The leg 9 is mounted on the drive transmission assembly 7 by mounting means comprising a substantially horizontal athwartships axis pivot connection including two pivot pins 12 (shown cut off in FIG. 3). In this way, the leg 9 can be swung up about the pivot connection on striking an obstruction.

The pivot pins 12 are received in respective inclined slots 13 in tubular side members 14 fixed to the drive transmission assembly 7. The side members 14 house the depending limbs of locking means in the form of an inverted-U shaped locking member 15. The locking member 15 has projecting abutments 16 which engage behind the pivot pins 12 and prevent accidental release by closing the mouths of the inclined slots 13. For deliberate release, the locking member 15 (whose upper bar forms a handle) must be raised against the downward biassing of two tension springs 17 (see FIG. 3). In this way, the leg 9 and associated parts can be readily removed to prevent tampering or theft. The engine 2 can also be arranged to be readily removed from its housing 3, leaving only the drive transmission assembly 7 and associated parts in the vessel.

Once it is suspended from its pivot pins 12, the leg 9 can rest in position by gravity and due to the propulsion force of the propeller 11. However, it is preferred to have some detent mechanism. As shown in FIGS. 2 and 3, the leg has two detent pins 18 (shown cut off in FIG. 3). As the leg 9 is lowered, the detent pins 18 engage and lift respective detent rollers 19 mounted on the locking member 15, which moves slightly upwards against the biassing of the springs 17. If an obstruction is struck, the detent pins 18 will push up the detent rollers 19 and allow the leg 9 to swing up.

The drive transmission assembly 7 includes a generally horizontal input steering shaft (or tube) 20. The steering shaft 20 may be connected by any suitable linkage to a steering wheel; such a construction can be devised without difficulty, and is particularly useful for instance for cruisers or even for inflatable dinghies. Alternatively, as shown in FIG. 1, the tiller 4 is directly pivoted to the steering shaft 20. If the steering shaft 20 is turned through 180° (see below), the tiller 4 can be pivoted through 180° about the transverse pivot axis through which it is connected to the steering shaft 20. The forward end of the steering shaft 20 can be carried in a glass-reinforced plastics material bush 21 fixed e.g. to the engine housing 3. The aft end portion of the steering shaft 20 carries a cam 22 whose function is described below. The aft end of the steering shaft 20 is locked to a clutch ring 23 which carries a number of spring-loaded pins or dogs 24. These dogs 24 engage in bores in an outer bevel gear 25 which forms part of steering transmission means connecting the propeller housing 10 to the steering shaft 20. The remainder of the steering transmission means is formed by a second outer bevel gear 26, a tubular shaft 27 and screws 28. The propeller housing 10 has its weight supported by the tubular shaft 27, but it can rotate about the axis of the leg 9, thereby steering the vessel without the use of a rudder. The dogs 24 form disengagable clutch means between the drive transmission assembly 7 and the leg 9, below the level of the pivot pins 12. Thus the dogs 24 are disengaged when the leg 9 is swung up. They can be reengaged by lowering the leg 9 and then rotating the steering shaft 20 until they move into their respective bores.

It is possible to rotate the propeller housing 10 through substantially more than 180°, in this case right through 360°. Thus the vessel may go astern without changing the direction of rotation of the propeller 11. In order to prevent the leg 9 swinging up when the vessel is being reversed, a locking means can be provided to prevent the locking member 15 lifting. In this case, there is automatic locking means actuated by the cam 22. The cam 22 engages a cam follower in the form of a forwardly-spring-biassed, horizontally-sliding bar 29 whose aft end carries a horizontal locking bar 30 (best seen in FIG. 3). When the bar 29 is pushed aft by the cam 22 (propeller housing 10 turned through 180°), the locking bar 30 engages in slots in the locking member 15, thereby preventing the locking member 15 being pushed upwards and hence firmly locking the leg 9.

The drive transmission assembly 7 also includes a generally horizontal input drive shaft 31 coaxially within the steering shaft 20. Any suitable construction can be provided for connecting the drive shaft 31 to the engine 2. However, FIG. 2 shows the drive shaft 31 sliding telescopically over a drive shaft 32 which can engage a drive output of the engine 2 by way of a dog clutch (not shown). The shaft 31 is rotational fixed to the shaft 32 by cross-pins 33 but is axially slidable and is biassed rearwardly by a compression spring 34 engaging a further cross-pin 35. At its aft end, the drive shaft 31 is pinned to a short shaft 36 which carries a cross-key 37. The cross-key 37 engages in a cross-slot in a shaft 38 carrying an inner bevel gear 39. The shaft 38 and the inner bevel gear 39 form part of drive transmission means connecting the propeller 11 to the drive shaft 31; the remainder of the drive transmission means is formed by a second inner bevel gear 40, a generally vertical connecting shaft 41, further bevel gears 42, 43, a stub shaft 44 and a friction clutch.

The friction clutch is formed by two drive members fixed to the stub shaft 44, namely drive disc 45 and a nose piece 46. The drive members sandwich between then the hub 47 of the propeller 11 and O-rings 48 are carried in annular grooves and are compressed between the respective drive members and the hub 47. The O-rings 48 act as sealing rings, the prevent the ingress of water, and their compression can be adjusted by means of a lock-nut (not shown) securing the nose piece 46 in position. The friction clutch prevents damage if the propeller 11 is snagged, for instance by being caught up in a rope. Having the friction clutch close to the propeller 11 keeps low the inertia of the parts which are stopped if the propeller 11 is snagged.

The input shaft 31 and the drive transmission means form a generally Z-shaped configuration; the input shaft 31 is roughly parallel to but spaced above the propeller axis, the connecting shaft 41 forming the cross-bar of the Z.

If the leg 9 swings up, the dog clutch cross-key 37 is disengaged. It is preferred to stop the engine 2 before re-engaging the clutch. This can be done by lowering the leg 9 and restarting the engine 2 so that the cross-key 37 reengages in its cross-slot at relatively low speed.

The drive transmission assembly 7 together with the leg 9 and associated parts can be swung generally about a horizontal fore-and-aft axis, the assembly 7 turning in the seal 8. This enables the depth of the propeller 11 beneath the water to be adjusted so as to permit passage through shallow waters. Doing this will give rise to a steering moment, but this can normally be allowed for. If there are two propulsion units, these two steering moments can balance; in such an arrangement, the vessel could be steering either by varying the relative speeds of the two propulsion units, or by using the individual steering shafts 20 and assocated mechanisms. Another advantage of being able to swing the leg 9 about the fore-and-aft axis can be obtained if the amount of swinging is very substantial and enables the propeller 11 to be brought above the water level. In this case, the propeller 11 can be inspected and also, for instance, ropes or lines can be disentangled from the propeller 11.

In FIG. 2, there is indicated a worm drive 51 which engages a bull ring on the drive transmission assembly 7 for swinging the leg 9 about the fore-and-aft axis, the assembly 7 rotating in the seal 8. Such an arrangement would not be appropriate for the dinghy 1 which is shown, but could be used for instance in a cruiser. In such a case, the worm drive 51 would be driven by a suitable electric motor. In a similar manner, the transom 6 is shown as being vertical in FIG. 2, though it is shown as sloping slightly in FIG. 1, the assembly 7 being suitably profiled.

Bearings and seals are provided in the normal way, but these are not described in detail. Any suitable method can be provided for lubricating the bearings, and the lubrication is not shown. For instance, the propeller housing 10 may be filled with oil and provided with a pump, driven by the shaft 41, to provide circulation for lubricating the upper end of the leg 9; thus, the shaft 41 can be formed as a tube and provided with an impeller to force a lubricant up the centre of the shaft 41, the oil return being achieved under gravity. Likewise, a re-circulating lubrication system can be provided for the input drive shaft 31 and associated parts.

Parts such as the casings of the assembly 7, propeller housing 10 and the casing at the top end of the leg 9 can be formed of any suitable material, such as glass-reinforced plastics material.

SECOND EMBODIMENT OF THE INVENTION

The second embodiment corresponds closely to the first embodiment, and similar parts are indicated with the same references and will not be described in detail.

In this case, the leg 9 is intended to be more permanently fixed to the drive transmission assembly 7, by means of screw pivots 49. The leg 9 is detained in its fully extended position by athwartships-sliding detent pins 50 which are sprung outwards. The heads of the pins 50 are chamfered, and engaged in holes in the side members 14. The detent pins slide in cross-bores in the aft part of the drive transmission assembly 7. In this way, the leg 9 can click home into its fully extended position, but can be released if an obstruction is struck. However, in order to lock the leg 9 when going astern under power, the sliding bar 29 is pushed aft by the cam 22 and passes between the inner ends of the detent pins 50, preventing their release.

In this embodiment, the sliding bar 29 is arranged below the level of the coaxial shafts 20, 31.

I claim:

1. A propulsion unit for a water-borne vessel, the unit comprising:

a drive transmission assembly comprising a generally horizontal input drive shaft for connection to an inboard ingine and an input steering shaft coaxial with the drive shaft;

mounting means for mounting the drive transmission assembly on the vessel, the mounting means permitting the drive transmission assembly to swing about a horizontal fore-and-aft axis;

a leg depending from the drive transmission assembly; whereby the leg swings about said generally horizontal fore-and-aft axis when the drive transmission assembly swings about said generally horizontal fore-and-aft axis;

mounting means mounting the leg on the drive transmission assembly, said latter mounting means comprising a substantially horizontal athwartships axis pivot connection, whereby the leg can be swung up about the pivot connection on striking an obstruction;

swinging means interconnecting said drive transmission assembly mounting means and the drive transmission assembly, for causing the drive transmission assembly to swing about said generally horizontal fore-and-aft axis;

a propeller housing supported on the lower end of portion of the leg for rotary movement generally about the axis of the leg;

steering transmission means connecting the propeller housing to said input steering shaft, for rotating the propeller housing to steer the vessel;

a propeller rotatably mounted on the propeller housing; and drive transmission means connecting the propeller to said input drive shaft for driving the vessel, the drive transmission means comprising disengageable clutch means between the drive transmission assembly and the leg, and below the level of said pivot connection, where the disengageable clutch means is disengaged when the leg is swung up;

the propeller housing being rotatable through substantially more than 180° so as to enable the vessel to go astern without changing the direction of rotation of the propeller, the propulsion unit further including automatic locking means for locking the leg in its fully extended position when the propeller housing is rotated through at least 90° from its direct forward position, the automatic locking means comprising a cam associated with the steering shaft, a cam follower which follows the cam, and a locking member actuated by the cam follower to prevent the leg swinging up about the pivot connection.

2. A propulsion unit for a water-borne vessel, the unit comprising:

a drive transmission assembly comprising a generally horizontal input drive shaft for connection to an inboard engine and an input steering shaft;

a leg depending from the drive transmission assembly, the leg being mounted on the drive transmission assembly by mounting means comprising a substantially horizontal athwartships axis pivot connection, whereby the leg can be swung up about the pivot connection on striking an obstruction;

a propeller housing supported on the lower end portion of the leg for rotary movement generally about the axis of the leg, the propeller housing being rotatable through substantially more than 180° so as to enable the vessel to go astern without changing the direction of rotation of the input drive shaft;

steering transmission means connecting the propeller housing to said input steering shaft, for rotating the propeller housing to steer the vessel;

automatic locking means for locking the leg in its fully extended position when the propeller housing is rotated through at least 90° from its direct forward position, the automatic locking means comprising a cam associated with the steering shaft, a cam follower which follows the cam, and a locking member actuated by the cam follower to prevent the leg swinging up about the pivot connection;

a propeller rotatably mounted on the propeller housing; and drive transmission means connecting the propeller to said input drive shaft, for driving the vessel, the drive transmission means comprising disengageable clutch means between the drive transmission assembly and the leg, and below the level of said pivot connection, whereby the disengagable clutch means is disengaged when the leg is swung up.

3. The propulsion unit of claim 2, wherein the steering transmission means comprises disengagable clutch means between the drive transmission assembly and the propeller housing, and below the level of said pivot connection, whereby the latter disengagable clutch means is disengaged when the leg is swung up.

4. The propulsion unit of claim 2 or 3, wherein the leg is completely disengagable from the drive transmission assembly, said pivot connection comprising at least one substantially horizontal athwartships axis pivot pin, at least one inclined slot for receiving the pin, and displacable locking means for substantially closing the mouth of the slot.

5. The propulsion unit of claim 2, wherein the input drive shaft and the input steering shaft comprised in the drive transmission assembly are coaxial.

6. The propulsion unit of claim 5, wherein the drive disengagable clutch means and the steering disengagable clutch means are in the form of coaxial respective dog clutches, comprising axially-movable spring-loaded members which engage in corresponding cut-outs.

7. The unit of claim 5, and including mounting means for mounting the drive transmission assembly on the vessel, the mounting means permitting the drive transmission assembly and the leg to swing about a horizontal fore-and-aft axis.

8. The propulsion unit of claim 2, wherein the drive transmission means comprises a friction clutch drive to the propeller, the friction clutch drive comprising a stub shaft, a hub of the propeller mounted on the stub shaft and able to rotate with respect thereto, first and second drive members rotationally fixed to the stub shaft on either side of the propeller hub, and sealing rings compressed between the propeller hub and the respective first and second drive members.

* * * * *